United States Patent [19]

Ichikawa et al.

[11] 4,208,017

[45] Jun. 17, 1980

[54] APPARATUS FOR TEMPORARY STOCK DISPENSER OF WIRE

[75] Inventors: Hiroshi Ichikawa; Masatake Yakura, both of Shizuoka, Japan

[73] Assignee: Yazaki Corporation, Tokyo, Japan

[21] Appl. No.: 14,819

[22] Filed: Feb. 26, 1979

Related U.S. Application Data

[63] Continuation of Ser. No. 858,379, Dec. 7, 1977, abandoned.

[30] Foreign Application Priority Data

Jan. 31, 1977 [JP] Japan ..... 52/008692

[51] Int. Cl.[2] ..... B65H 51/20

[52] U.S. Cl. ..... 242/47.01; 242/47.12; 242/82

[58] Field of Search ..... 242/47.01, 47.12, 82, 242/83, 47

[56] References Cited

U.S. PATENT DOCUMENTS

| | | | |
|---|---|---|---|
| 1,187,827 | 6/1916 | Gibbs | 242/82 |
| 3,013,741 | 12/1961 | Bittman | 242/82 |
| 3,029,039 | 4/1962 | Martinez | 242/82 |
| 3,049,315 | 8/1962 | Nye | 242/82 |
| 3,064,919 | 11/1962 | Nye et al. | 242/82 |
| 3,411,548 | 11/1968 | Pfarrwaller | 242/47.12 X |
| 3,737,112 | 6/1973 | Tellerman et al. | 242/47.12 X |
| 3,759,300 | 9/1973 | Pfarrwaller | 242/47.01 X |
| 3,761,031 | 9/1973 | Pfarrwaller | 242/47.01 |
| 3,834,635 | 9/1974 | Pfarrwaller | 242/47.01 |
| 4,068,807 | 1/1978 | Jacobsson | 242/47.01 |

*Primary Examiner*—Stanley N. Gilreath
*Attorney, Agent, or Firm*—Armstrong, Nikaido, Marmelstein & Kubovcik

[57] ABSTRACT

This invention provides an apparatus for temporarily stocking a dispenser of wire which comprises a support frame, a rotating member supported by the support frame, a driving device for driving the rotating member, a wire winding storage drum rotatably and coaxially mounted to a front end portion of the rotating member through a planet gear system, a wire guide passage extending through the axis of the rotating member and turned radially at the forward side of the drum leading to a position at the external edge of the drum flange, whereby a predetermined quantity of wire can be temporarily stored on the drum so as to be ready for giving a smooth tangle free supply of wire to a work place.

8 Claims, 6 Drawing Figures

Prior art

APPARATUS FOR TEMPORARY STOCK DISPENSER OF WIRE

This is a continuation, of application Ser. No. 858,379, filed Dec. 7, 1977, now abandoned.

BACKGROUND OF THE INVENTION

This invention relates to an apparatus for temporarily stocking wire from which a predetermined quantity of thin wire can be readily supplied to a work place. A wire stocking apparatus is known from prior art, such as that which is described as follows referring to FIG. 6. The prior art apparatus comprises a frame 80 which is divided into two sections 82*a* and 82*b* by a wall 81. Holes 84, 85 and 86 are provided in walls 81, 83*a* and 83*b* of frame 80. Adjacent the hole 84 in wall 83*a* there is provided roller 90 having a pulley 89 coaxially fixed thereto. The roller 90 is driven through an endless belt 88 on the pulley 89 by the motor 87. Opposite roller 90 is another roller 91, both serve as feed rollers and guides for the wire T. Adjacent the rollers 90 and 91 a torsion releasing unit is provided which has a support plate 93 comprising two pieces 93*a* and 93*b* arranged at right angles to each other including a plurality of rollers 94 each pair being rotatably disposed to each other and holding the wire T.

The known apparatus is provided with a plurality of phototubes 95 at the base of the frame 80. The wire T free of torsion passes through the hole 84 and is looped in first section 82*a*, then through hole 85 in wall 81 and looped again in the second section 82*b*, and then passes through hole 86 in wall 83*b* to the work place (not shown). Passage of the wire is under the influence of the feeding mechanism of the rollers 90 and 91 the endless belt 88 and the motor 87, until the loop of wire breaks the ray emitted by phototube 95 in section 82*a* and/or 82*b*.

In this prior art apparatus there are drawbacks in that the wire T tends to be damaged by its passage through the rollers and holes in the apparatus, and there is a tendery for the wire to become entangled before the hole 86 in frame 80.

The stock of wire is limited to that contained in the loop in section 82*a* and 82*b*. If more wire is required to be stocked then the apparatus must be made much larger.

SUMMARY OF THE INVENTION

This invention is intended to overcome the deficiencies of prior art and it is an object of the present invention to provide a novel and useful apparatus for stocking and dispensing wire which is wound around a drum.

Another object of the invention is to provide an apparatus in which the wire can be smoothly supplied to the working place without becoming entangled.

A further object of the invention is to provide an apparatus in which the wire stock is wound around the drum, so that when compared to conventional apparatus a larger quantity of wire can be stocked with a smaller apparatus size occupying a far smaller area at a reduced cost.

The invention will become apparent to those skilled in the art from the following detailed description.

Essentially, according to the present invention, there is provided an apparatus for temporarily stocking wire ready for use at a working place, comprising a support body, a rotating member supported by said support body, a driving means for driving the rotating member, a wire winding and storage drum rotatably and coaxially mounted to a front end portion of the rotating member and operatively connected thereto through a planet gear system, a wire guide passage means extending along the axis of the rotating member and changing the direction at a position near the drum, and means for winding the wire around the drum.

DETAILED DESCRIPTION OF THE PREFERRED EMBODIMENT

Figure 1:
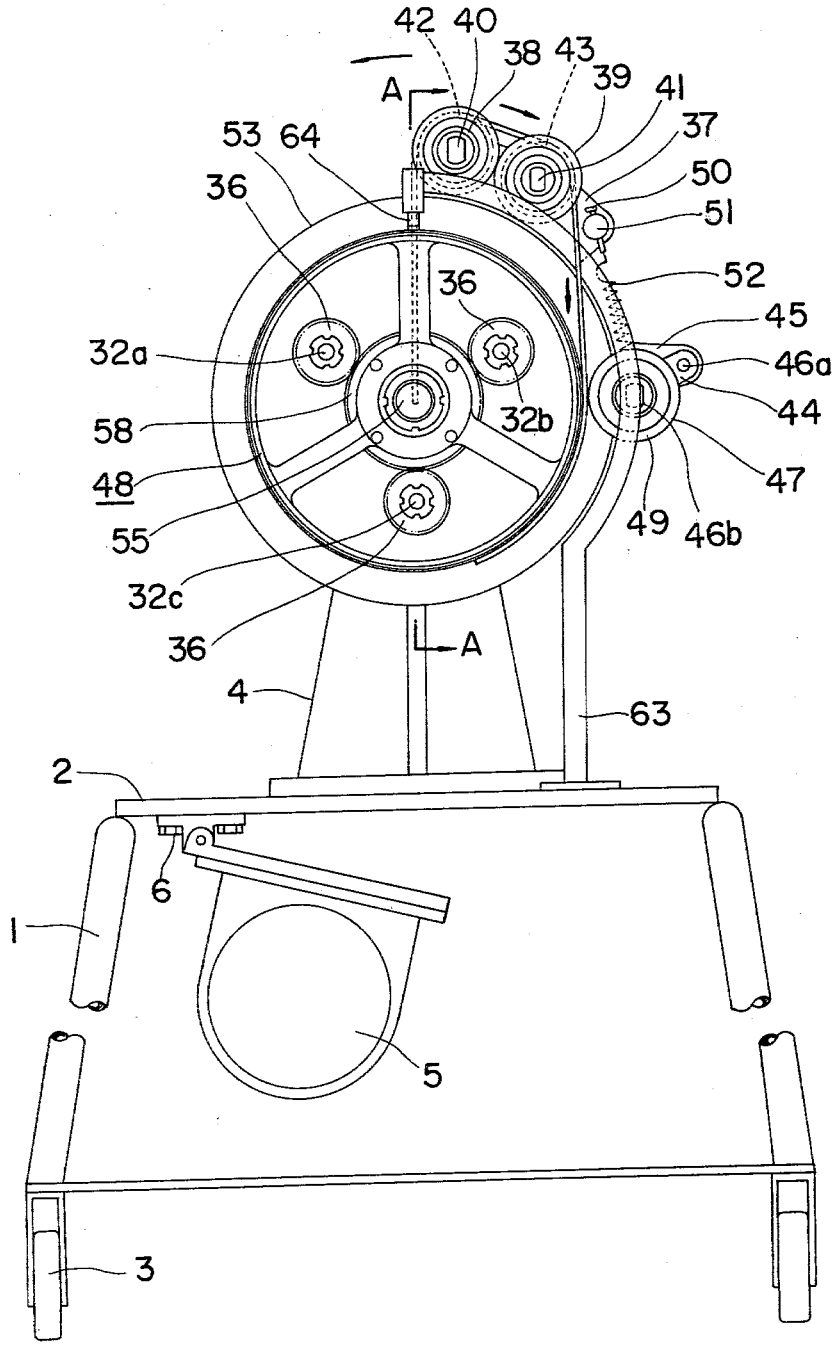
FIG. 1 is a partially cutaway front view showing an embodiment of the apparatus for temporarily stocking wire according to the present invention.

Referring now to FIGS. 1 through 4 showing an embodiment of the present invention, 1 is a frame made from steel, 2 is a base plate fixed to the top of the frame 1, 3 are casters each fixed to the lowest end of four corners of the frame 1.

A support member 4 is fixedly mounted to the upper surface of plate 2, and extending upwardly. A motor 5 is fixed to the undersurface of the plate 2 with bolts 6. To a free end of a motor shaft 7 a first pulley 8 is fixedly supported. A bearing section 9 which is the upper portion of the support member 4, is formed with an axle bore 10 through which the rear end portion of a driving shaft 11 is inserted and rotatably mounted. The driving shaft 11 protrudes at the rear end from the rear wall face of the support member and is fixedly provided with a second pulley 12 at the rearmost end. An endless belt 13 is stretched between the pulleys 8 and 12. A through hole 14 extends along the axis of the driving shaft from the rearmost end to a first notch 15 formed in an intermediate portion of the driving shaft 11. A collar 16 is fitted on the rear end portion of the driving shaft 11. The driving shaft 11 is supported on the supporting member 4 by means of bearing 17*a* and 17*b* disposed at each end of the axle bore 10. A securing plate 18 is fixed to the rear end face of the support member 4 to axially secure the driving shaft 11 in position together with the bearings 17*a* and 17*b*. A toothed wheel 20 has a central bore 21 into which the driving shaft 11 is rotatably inserted. The toothed wheel is arranged on the forward end face of the supporting member 4 and secured by a bolt 22 coaxially with the axle bore 10. A second notch 24 the surface of which lies on the same plane as the first notch 15 of the driving shaft 11 is provided on its internal periphery with a stepped portion 26 which is mated to a stepped portion 25 of the rotating member 23. The rotating member 23 is fitted to the driving shaft 11 at the intermediate portion of the shaft 11 and fixed by a bolt 28.

Numeral 29 is a direction changing roller rotatably supported to the rotating member 23 by a pin 30 and secured within the first notch 15 of the driving shaft 11 at right angle to the axis of the rotating member thereby change the advancement of the wire T from an axial direction to a radial direction. The roller 29 is provided at its external periphery with a circumferential groove 31 to guide the wire T.

Numeral 32 designates second axle bores formed in the rotating member 23 equally spaced, for example, 120 degree to each other (refer to FIG. 1) and 32*a*, 32*b* and 32*c* are shafts disposed in each one of the axle bores 32, and each with a collar 33 fitted thereto. Numerals 34*a* and 34*b* are bearings disposed at both ends of the collar on the shaft within the axle bore 32 and supporting the shaft 32*a*, 32*b* and 32*c* for smooth rotation. Numerals 35 and 36 indicate planet gears secured at both ends of the shafts 32*a*, 32*b* and 32*c*, the planet gear 35 has an equal ratio to the toothed wheel 20 and meshes therewith.

Numeral 37 designates a roller support plate fixed to the rotation member 23 and outwardly extending from its periphery. Numerals 38 and 39 respectively show a guide roller and an input roller and pivotally mounted to the roller support plate 37 by means of shaft 40 and 41. The rollers 38 and 39 are provided respectively at their external peripheries with guide grooves 42 and 43 to guide the wire T to be wound on the periphery of a drum 48.

Figure 4:
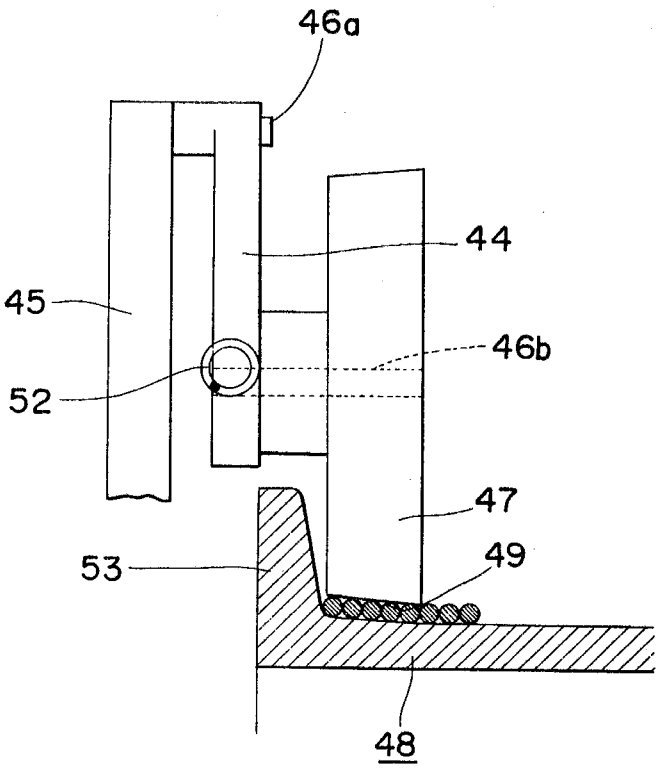
FIG. 4 shows a partially enlarged vertical section view of a press roller in the apparatus.

Numeral 44 is a lever at one end pivotally connected by means of a pin 46*a* to an arm 45 which is fixedly mounted to the roller support plate 37. Numeral 47 designates a press roller rotatably connected to the other end of the lever 44 by means of a shaft 46*b* and having a tapered portion 49 as shown in FIG. 4 at its external periphery to press the wire T against the external periphery of the drum 48.

Numeral 50 designates a hook bolt secured by means of pin 51 to the roller support plate 37. Numeral 52 is a tension spring fixed at one end to the lever 44 and at the other end to the hook bolt 50 and adapted to press the roller 47 against the external periphery of the drum 48 for pressing the wire around the drum 48.

The drum 48 is provided at its inner end with a flange 53 and at its center with a boss 54 to receive a portion 55 formed at the forward end of the driving shaft 11 through a collar 56 in which the portion 55 is rotatably supported by bearings 57*a* and 57*b*. An edge of the tapered portion 49 of the press roller 47 cooperates with the flange 53 to form a gap smaller than the diameter of the wire and, as clearly seen in FIGS. 4 and 5, to prevent the wire from slipping up the roller 47 and the flange 53.

Numeral 58 is a toothed wheel fixed to the drum 48 by a bolt 60 which meshes with planet gear 36 in equal ratio.

Numeral 61 is a retainer fixed to the drum 48 by a screw 62 to secure the bearing 57*b* in position within the boss 54, and numeral 63 designates a switch holding member which is fixed to the upper surface of the plate 2. A limit switch 64 is mounted to the top of the holding member 63 and is electrically connected to the motor 5 through a wire (not shown) to switch off the motor 5 when a leaf spring 64*a* comes in contact with and is pressed by a portion of the wire T wound around the drum 48.

Numeral 65 is a hood of a truncated conical shape which covers the forward end of the drum 48 and at the internal peripheral surface of its rear end there is attached a friction member 66 such as compressed felt which contacts a part of the pulled wire which is wound around the external periphery of the drum to give friction to the wire and so prevent wire entanglement as the wire feeds off the drum. The forward end of the hood 65 has a front wall formed with a center hole 67 into which is fitted a guide ring 69 forming an outlet 68 for the wire. The guide ring 69 is made of a material which will not damage the wire when it is drawn through the wire outlet 68. Numeral 70 is a hood support unit which is composed of a support plate member 73, a holder 75 fixed to the base plate 2, a stand 71 connected at the upper end to the support plate member 73 and at the lower end pivotally connected to the holder by means of a pin 74, and a reinforcement rib 72 connected to the supporting plate member 73 and the stand 71.

With the above described arrangement, the driving shaft 11 is rotated in the axle bore 10 by a driving mechanism including the motor 5, the first pulley 8 mounted one end of the motor shaft 7, the endless belt 13 and the second pulley 12 mounted to one end of the driving shaft 11.

The rotation of the driving shaft 11 rotates the rotating member 23. The roller support plate 37, the guide roller 38, the input roller 39 and the press roller 47 simultaneously rotate with the rotating member 23.

At this time, each planet gear 35 provided at one end of the shafts 32*a*, 32*b* and 32*c* which are rotatably disposed within corresponding axle bores 32 to rotate around the toothed wheel 20. The planet gear has a ratio equal to that of the toothed wheel 20 and rotates around the toothed wheel 20 with the teeth meshed with those of the toothed wheel 20. The planet gear 36 also has a ratio equal to that of the toothed wheel 58 fixed to the boss portion of the drum 48 and therefore rotates around the toothed wheel 58 with the teeth meshed with those of the wheel 58. So the toothed wheel 58 and then the drum 48 remain stationary while the rotating member is rotated.

Before the winding operation the wire T is inserted into the hole 14 of the driving shaft 11 at the rear end and guided along the hole in its advancing direction. The wire T is then guided around the direction changing roller 29 and further passes through a space formed by the first notch 15 of the driving shaft 11 and the second notch 24 of the rotating member 23 and is guided in the guide grooves 42 and 43 of the guide roller 38 and the input roller 39. The wire is further guided between the press roller 47 and the periphery of the drum.

After the setting of the wire as stated, the driving shaft 11 is rotated to rotate the guide roller 38 together with the input roller 39 and pushing roller 47. So these rollers press the wire T against the external periphery of the drum 48 and winds the same around the drum 48. As shown in FIG. 4 the pushing rollers 47 presses the wire by the tapered portion 49 formed at its external periphery.

Figure 2:
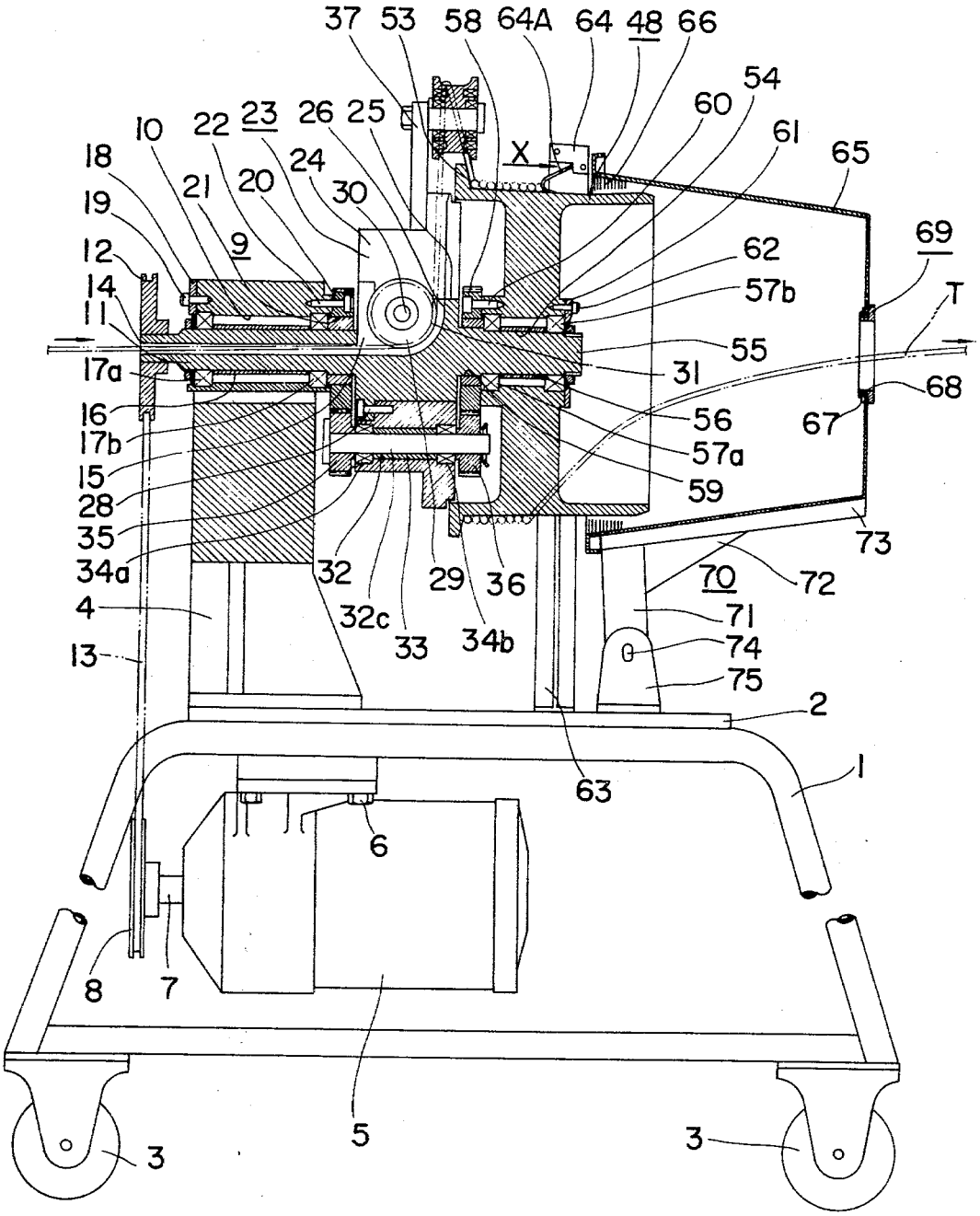
FIG. 2 is a sectional view of the apparatus taken along the A—A of FIG. 1.
Figure 3:
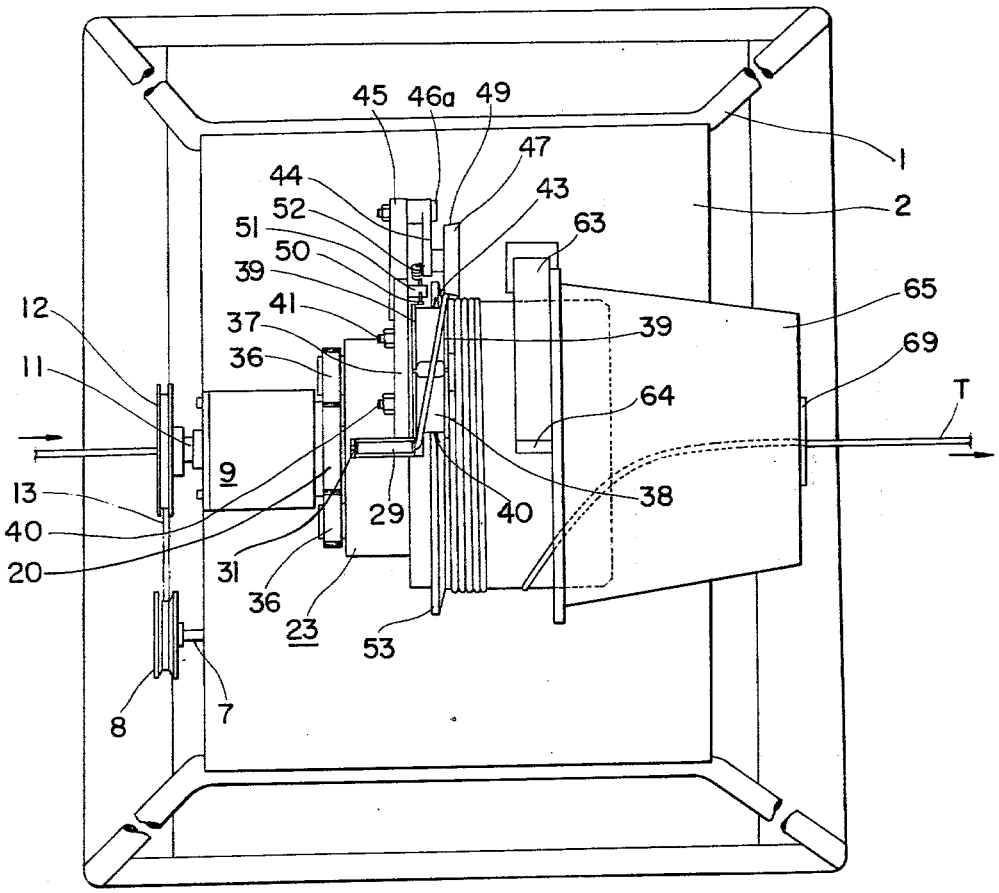
FIG. 3 is a partially enlarged plan view of the apparatus.

Thus, the portion of the wire T previously wound around the drum 48 is displaced on the surface of the drum by the pressure exerted by the following portion of the wire T in a direction as indicated by an arrow at X in FIG. 2.

Figure 5:
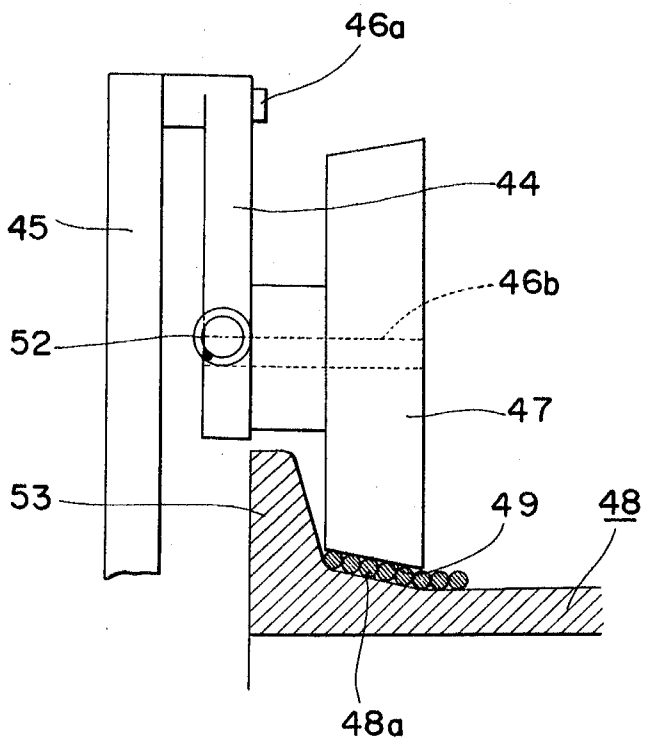
FIG. 5 is a partially enlarged vertical section view of a modification of a press roller of the apparatus.

FIG. 5 illustrates another form of the drum 48 according to the present invention in which there is provided adjacent to and outside of the flange 53 as shown in FIG. 5 a tapered portion 48*a* corresponding to the tapered portion 49 of the press roller 47.

In this embodiment, the wire T is also pressed by the tapered portion 49 of the press roller 47 and wound around the drum 48. One portion of the wire T previously wound around the drum 48 is displaced by a pressure exerted by the following portion of the wire T in the direction as shown by an arrow at X in FIG. 2.

The embodiment illustrated in FIG. 5 differs from that of FIG. 4 in that the drum 48 is provided adjacent to and outside of the flange 53 with a tapered portion 48*a* corresponding to the tapered portion 49 formed on the external periphery of the press roller 47 so that portions of the wire T as wound around the drum 48 can be easily guided in the forward direction as shown by the arrow at X of FIG. 2.

The apparatus of the present invention is arranged so that when one portion of the wire T touches a leaf spring 64*a* connected to a limit switch 64, the limit switch is operated and the motor 5 is deenergized to stop the rotation of the driving shaft 11. Thus, a predetermined quantity of wire T is automatically wound around the drum 48 to maintain stock of the same.

The wire T wound around the drum 48 of the apparatus according to the present invention, presents a spiral form so that the wire T can be smoothly drawn without entanglement from the opening 68 of the annular guide member 69 mounted to the opening 67 formed on the front side of the hood 65 and can be smoothly supplied to the working place (not shown).

In case where the wire T whirls on the external periphery of the drum 48, the shock caused by the whirling motion of the wire T is absorbed by a shock absorbing member 66 provided at the rear end of the hood 65.

When the wire T in stock quantity is used and decreased, the limit switch 64 is operated to start the rotation of the drive shaft 11 for winding the predetermined quantity of wire T around the drum 48.

In the embodiment disclosed hereinabove, the drum 48 is rotatably supported by a structure which consists of the toothed wheel 58 connected to the drum 48 and the planet gear 36 meshes with the toothed wheel 58 so that the wire T wound around the drum 48 can be smoothly drawn out from the wire outlet 68.

Figure 6:
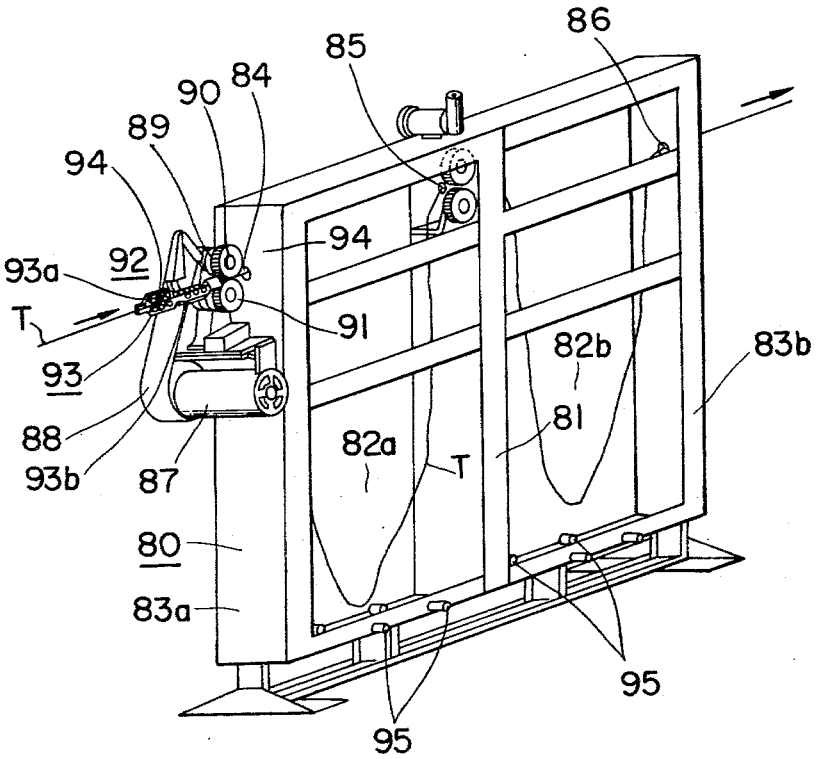
FIG. 6 is a perspective view of a conventional apparatus for temporarily stocking wire.

The apparatus for temporarily stocking the wire T automatically spirally winds a predetermined quantity of thin wire around the drum for stock and smoothly supplies the wire tangle free to the working place. At the same time, the apparatus stocks the wire by spirally winding the same around the drum so that the apparatus can stock a large quantities of wire although the total size of the apparatus is smaller than the device illustrated in FIG. 6.

Further, because of its smaller size, the apparatus is cheap to install and operate.

What we claim is:

1. An apparatus for stocking wire ready for use at a work place comprising:

(a) a support body;

(b) a rotating member means carried by said support body;

(c) a drive means for rotatably driving said rotating member means;

(d) a wire storage drum coaxially mounted to said rotating member means, said wire storage drum including a tapered portion and a generally cylindrical portion, said tapered portion having a larger diameter than, and decreasing in diameter towards, said generally cylindrical portion, said tapered portion including a flange at a position remote from said generally cylindrical portion;

(e) a wire guide passage means for supplying wire to said rotating member means, said rotating member means winding said wire on said wire storage drum tapered portion; and (f) a press member means supported by said rotating member, an edge of said press member means cooperating with said flange to form a gap smaller than the diameter of the wire, said press member means having a tapered surface, said tapered surface being positioned in registry with said drum tapered portion, said press member means tapered surface and drum tapered portion cooperating to squeeze said wire, whereby a length of wire previously wound around said wire storage drum is displaced by pressure exerted by a following length of wire in the direction of said generally cylindrical portion, the difference in the diameters of said tapered and cylindrical drum portions in cooperation with said press member means resulting in loosely wrapped wire on said cylindrical drum portion.

2. An apparatus for stocking wire as claimed in claim 1 further comprising:

a hood having a truncated conical shape and being adapted to cover at least a portion of said cylindrical drum portion remote from tapered drum portion; and a friction member attached to the internal periphery of said hood for imparting friction to wire pulled axially of said drum.

3. An apparatus as claimed in claim 2 wherein said rotating member means has a rearwardly extending shaft which is rotatably supported by a through bearing formed in said support body.

4. An apparatus for stocking wire as claimed in claim 3 wherein said drive means comprises a first pulley provided at the rear end of the shaft, a motor fixedly mounted to the support body, a second pulley mounted to a rotating shaft of the motor and a transmission belt mounted over the first and second pulleys.

5. An apparatus for stocking wire as claimed in claim 3 wherein said wire guide passage means comprises a through hole extending forwardly from the rear end of the shaft along the axis of said rotating member means, a cut-out portion provided in the rotating member and communicating with the front end of the through hole, a roller provided in the cut-out portion and arranged so as to change the advancing direction of the wire, and at least one pulley rotatably supported by the rotating member in a position adjacent to the rear end of the drum and outside the external periphery of the drum for guiding the wire to the outer periphery of the drum.

6. An apparatus for stocking wire as claimed in claim 2 further comprising a sensor being positioned close to the peripheral surface of the drum with a predetermined distance from the rear end of the drum for sensing a certain quantity of windings of wire on the drum.

7. An apparatus for stocking wire as claimed in claim 1 wherein said press member means comprises a rotating disk with an axis parallel to that of said rotating member means.

8. An apparatus for stocking wire as claimed in claim 7 wherein said rotating disk includes a truncated conical surface tapered toward the rear end of said wire storage drum.

* * * * *